US005295797A

United States Patent [19]

Kahrs et al.

[11] Patent Number: 5,295,797

[45] Date of Patent: Mar. 22, 1994

[54] RADIAL PISTON PUMP

[75] Inventors: Manfred Kahrs, Wiesbaden; Gerhard Kunz, Linden; Franz Fleck, Langenselbold; Hermann Schoellhorn, Frankfurt am Main; Gerhard Schudt, Hanau; Winfried Huthmacher, Frankfurt am Main, all of Fed. Rep. of Germany

[73] Assignee: Alfred Teves GmbH, Frankfurt am Main, Fed. Rep. of Germany

[21] Appl. No.: 854,636

[22] PCT Filed: Nov. 5, 1991

[86] PCT No.: PCT/EP91/02085

§ 371 Date: Jul. 6, 1992

§ 102(e) Date: Jul. 6, 1992

[87] PCT Pub. No.: WO92/08051

PCT Pub. Date: May 14, 1992

[30] Foreign Application Priority Data

Nov. 6, 1990 [DE] Fed. Rep. of Germany ..... 4035180
Oct. 31, 1991 [DE] Fed. Rep. of Germany ..... 4135904

[51] Int. Cl.[5] ..... F07B 1/04

[52] U.S. Cl. ..... 417/273; 417/462; 91/491; 92/72

[58] Field of Search ..... 417/273, 289, 440, 462, 417/502; 91/491; 92/72, 178, 174

[56] References Cited

U.S. PATENT DOCUMENTS

| | | | |
|---|---|---|---|
| 2,371,078 | 3/1945 | Summers | 91/494 |
| 2,529,309 | 11/1950 | Purcell | 91/498 |
| 3,961,558 | 6/1976 | Dokukin et al. | 91/491 |
| 4,605,359 | 8/1986 | Suzuki et al. | 417/273 |
| 5,049,039 | 9/1991 | Knoth et al. | 417/273 |

FOREIGN PATENT DOCUMENTS

| | | |
|---|---|---|
| 1528613 | 10/1970 | Fed. Rep. of Germany . |
| 2061960 | 6/1972 | Fed. Rep. of Germany . |
| 2061961 | 6/1972 | Fed. Rep. of Germany . |
| 2239635 | 2/1973 | Fed. Rep. of Germany . |
| 2204213 | 5/1974 | Fed. Rep. of Germany . |
| 7524746 | 1/1977 | Fed. Rep. of Germany . |
| 2601970 | 7/1977 | Fed. Rep. of Germany . |
| 2828022 | 1/1980 | Fed. Rep. of Germany . |
| 2946746 | 5/1981 | Fed. Rep. of Germany . |
| 3628769 | 3/1988 | Fed. Rep. of Germany . |
| 3728448 | 5/1988 | Fed. Rep. of Germany . |
| 3641955 | 6/1988 | Fed. Rep. of Germany . |
| 3700573 | 7/1988 | Fed. Rep. of Germany . |
| 570252 | 6/1945 | United Kingdom . |
| 1567100 | 5/1980 | United Kingdom . |
| 2198485 | 6/1988 | United Kingdom . |

*Primary Examiner*—Richard A. Bertsch
*Assistant Examiner*—Peter Korytnyk
*Attorney, Agent, or Firm*—Robert P. Seitter; J. Gordon Lewis

[57] ABSTRACT

A suction-restricted radial piston pump is described, in particular for use with automotive vehicles. The pump delivers a flow constant over a broad speed range and involving low losses in output and generating only negligible noise. In one embodiment, a control slot (13), on the pressure side, is subdivided into several grooves (27,28) which at least in part are in communication, through check valves (32), with the pressure connection (20). An alternative embodiment provides a shape of the pressure-sided control slot in which the introducing end thereof is comparatively narrow to reduce noise at a high speed and the outlet-sided end thereof with a wider width sufficient to meet the required output. According to a third embodiment, the suction-sided slot (12) is provided with a narrow width section and a subsequent wider width section.

8 Claims, 3 Drawing Sheets

RADIAL PISTON PUMP

BACKGROUND OF THE INVENTION

This invention is concerned with a suction-restricted piston pump, in particular, a radial piston pump. Piston pumps are frequently actuated by varying speed drive units, such as internal combustion engines. However, the required flow rate, frequently, is available at a low drive speed, and does not increase with a rising drive speed.

To adapt the supply characteristic to this requirement, DE-AS 20 61 960 describes a radial piston pump having cylinders radially disposed in a housing approximately lying within a plane, and spring-loaded pistons actuated by an eccentric, wherein the pumped fluid is drawn in through grooves disposed circumferentially of the eccentric. The fluid is pumped through hollow pistons and through at least one check valve in the housing. The pistons are configured as throttles in that a restriction plate is respectively provided between a shoulder in the eccentric-sided end of the pistons and the restoring springs. This configuration insures that, with a rising speed, an increasing resistance is created on the pump fluid on the suction side so that the volumetric delivery, after the pump reaches a predetermined speed, no longer rises linearly with speed but rather reaches a maximum value which is almost independent of further pump speed increases.

Hydraulic oils are only slightly compressible. The pressures developing during movement of the piston can, therefore, become very high, resulting in overloading of the pump, or causing the pump to be stalled.

To overcome this problem, control slots have been provided both on the intake side and on the pressure side, which extend over a major area along the direction of movement of the piston bore to thereby steady both the suction and the pumping operation. Pumps of this type, generally, are satisfactory in operation.

However, substantial problems will arise once it is attempted to have such pumps provided with control slots employed in suction-restricted operations. As long as the operation is still in a low speed range, the cylinders are completely filled with pressure fluid, as in pumps with no suction-restricted operation, and hence, a pump of this type operates as a pump with no suction restriction. However, once a critical speed is exceeded, the respective pumping chambers, during the suction process, no longer are completely filled with hydraulic fluid so that a very low pressure or vacuum prevails within the pressure chamber upon commencement of the compression operation of the piston. If a vacuum forming pumping chamber of this type has access to the pressure of the pressure-sided control slot under the output pressure of the pump, the pumping chamber is abruptly filled with pressure fluid which, in the continued rotary movement of the pumping chamber, is compressed in the usual manner and prior to reaching the end of the pressure-sided control slot, is again forced out by the piston.

The operations described hereinbefore result in substantial noise, which is very disadvantageous, especially so if the working environment of the pump is quiet. This applies, for example, to modern automotive vehicles increasing levels of noise suppression. Incidentally, the movement of the pressure fluid from the pressure channel, through the pressure-sided control slot, into the pumping chamber and back involves a substantial loss in output, thereby unnecessarily loading the drive unit of the pump.

The afore-described operations, in analogy, also apply, in modified form, to the suction side so that also in this respect measures will have to be taken to insure a noise reduction and to reduce losses in output. However, in this respect, it will have to be noted that the vacuum in the pumping chamber developing on the suction side can be more easily controlled than the incompressible hydraulic fluid on the pressure side. It is, therefore, quite possible, by reducing the length of the suction-sided slot, to attain a throttling effect, thus foregoing the provision of a separate throttle, thereby insuring an enhanced output and a reduced noise development. The length of the suction-sided slot is only a fraction of the length of the pressure-sided slot. Optionally, the suction-sided slot can be eliminated altogether.

Thus, a disadvantage involved with the state-of-the-art types of pumps resides in the non-uniform delivery occurring during operation on an effective restriction of the suction flow, creating steep pressure drops, during opening of the pressure valves, and mechanical noise during opening and closing of the pressure valves. Accordingly, conventional pumps are relatively noisy in operation for which reason they are not suitable for a variety of end-use applications, such as in private passenger cars.

A radial piston pump of the afore-mentioned type is also known from DE 37 00 573 A1. The rotor of the prior known radial piston pump is rotatably disposed on a control pin which is provided, in the plane of the piston bores, with two control slots of a large cross-section compared to the piston bores, and being substantially uniform throughout the length thereof. To reduce non-uniformities of the liquid flow, in the conventional radial piston pump, a restricting communication leads from the high-pressure control slot, to a pressure chamber formed in the control pin. A passageway emerges from the pressure chamber which terminates on the web and approximately at the outer dead center between the low pressure control slot and the high pressure control slot, based on the direction of rotation of the rotor and, periodically, is in communication with the pumping chambers in the piston bores. This is to insure an improved switch-over from the low pressure side to the high pressure side at the dead center. However, that measure is not suitable to avoid, in a control of the rating, through restriction of the suction flow, pressure pulsations when the piston bore pumping chamber is only partly filled during the suction stroke passes to the high pressure level of the control slot of the pressure side. Piston pumps of that type, hitherto, have not been used with a suction-restricted control on the intake side.

The invention, therefore, has as its object to reduce noise and power requirements of the above described type of pump by simple means.

SUMMARY OF THE INVENTION

This problem is solved by substantially avoiding, on the pressure side, a return flow from the pressure passageway to the pumping chambers of a low or vacuum pressure at the front-sided end of the pressure-sided slot. One solution essentially is achieved by pumping the incompressible fluid through a pressure control groove (hereinafter frequently designated by damping groove) and, preferably, a check valve, to the pressure connection or, by substantially reducing the return flow of the hydraulic pressure fluid through a special configuration of the slot-type pressure control orifice. A third alternative provides a restriction groove on the intake side to insure reduced noise development and enhanced output.

The pressure control groove or damping groove employed on the pressure side also can successfully be formed by a plural number of pressure control grooves separated from one another by separating webs, which are in communication, respectively through a check valve, with the pressure connection. It goes without saying that also the pressure control grooves, through check valves, can be individually connected to the pressure passageway to the pressure bore.

The invention provides a particularly simple design for a pump in which the rotor is rotatably mounted on the control pin, with fluid pumped radially inwardly through control grooves on the control pin surface.

The input of the pump can be supplied easily and the load on the pump components decreased by providing a pressure orifice in the form of a groove extending in the direction of the rotor rotation as the rating of the pump is thereby increased and the pressure load within the pressure chamber is reduced.

As set out previously, a further reduction of noise and an enhanced output can be attained by a plurality of pressure control grooves, which, however, involves slightly higher manufacturing costs. In practice, one single pressure control groove will well do.

Preferably the separating web between the pressure control groove and the pressure orifice is greater than the diameter of the piston bore to ensure optimum performance.

Unless such measures be taken, the pressure differences in the individual pressure control grooves, through the pumping chamber, are likely to be short-circuited so that additional noise and power input would occur.

Moreover, it is especially advantageous, for optimizing the way of operation of the pump according to the invention, to configure the length of the pressure control groove to be shorter than the distance between successive piston bores, as the pressure difference, in two successive pumping chambers, through the pressure control groove itself and possibly also through the pressure control orifice if excessively long, is otherwise balanced which, in turn, results in a noise development and losses in output.

Actually, the configuration of the pressure control groove according to the invention is uncritical which involves advantages in the manufacture of such a groove. For improving the invention, it is advisable to use a rectangular shape, as the damping groove can then be made by a simple milling operation.

A pump according to the invention utilizing four equidistant pistons, a pressure control groove extending 70°, a pressure control orifice extending about 45°, and a separating web extending about 20° has proved to be especially efficient.

A further simplification is achieved by the rotor being rotatable on the control pin with lengthwise passageways for the pressure and suction channels as well as the damping passageway, allowing these to be drilled.

An alternative is in interconnecting the pressure control groove and the pressure bore through a sloping bore substantially extending in the radial direction, and in inserting the check valve in the sloping bore.

The effect of the check valve will be especially advantageous when located adjacent the pressure control valve in substantially preventing a return flow pattern from occurring. According to an advantageous embodiment of the invention, also the check valve can be provided in a separate damping channel.

Another embodiment interconnects, through a check valve, the channels leading out of the control pin, toward the pump outlet, in the pump housing only.

Another solution to the problem according to the invention is easily attained by connecting the pressure control groove to the pressure control opening, with no separate communication with the pressure connection. However, the so formed pressure control groove should be of a substantially smaller cross-section than the pressure groove constituting the control opening. This will enable a substantially simpler design of the pump which, however, is subject to two restrictions. On the one hand, the sizes of the individual grooves are dependent on the pump rating and on the selected speed, from which speed and higher the volumetric rate will no longer increase (full-load speed regulation). Hence, for optimizing the noise and output pattern, the size of the grooves will have to be adapted to the respective pump.

The pressure control or damping groove, hence, reduces the gradient of the pressure rise in the pumping chamber at speeds that are above the full-load speed regulation. In that speed range, the pumping chambers in areas of the pressure-sided control orifice, in part, are filled with pressure fluid and, in part, with vapor or vacuum, respectively. The damping groove will damp the return flow of the pressure fluid from the pressure side into the pumping chamber while the pressure fluid/vapor mixture is precompressed therein by the retraction movement of the pistons causing an improved pressure adaptation between the pumping chambers and the pressure connection, thereby decidedly reducing pressure pulsations. However, it will have to be noted that the relatively small cross-section of the damping groove also may cause substantial output losses that are disadvantageous if—as, for example, in the case of automotive vehicles —the drive unit (vehicle engine) is of a restricted efficiency or is to be of an energy-saving design.

According to an advantageous embodiment, it is advisable to use a pressure groove substantially larger than the pressure control or damping groove. The cross-section of the damping groove, preferably, is small. Tests have shown that, depending on the pump size and the field of end-use application, a ratio of the area of the cross-section of the damping groove, to the stroke volume of a piston, is in the range of 1:1000 to 1:1600, preferably 1:1300 is recommended.

The damping groove preferably extends across an angular range from 30° to 50° and can be configured as a triangular groove with an aperture angle of about 60°. The layout of length and cross-section of the damping groove forms a compromise between the elevated force-out resistance at low speeds and the desired return flow damping at elevated speeds. In this respect, the pressure in the pumping chambers, in no operating phase is allowed to exceed the permitted maximum value.

The cross section of the pressure groove joining the damping groove, in the practice of the invention, is just sized that the pistons are able to force out the sucked volume against the system pressure on the pressure connection without generating a non-permitted high pressure rise in the pressure chambers. In this connection it has proved advantageous that the cross-section of the pressure groove is at least twice as large as the cross section of the damping groove. Moreover, it has proved to be advantageous that the space from the end of the pressure groove to the suction-mode dead center is equal to or smaller than the radius of the piston stem bores, thereby avoiding pressure peaks at the end of the retraction stroke of the pistons. An additional damping effect on the pressure side, in the practice of the invention, is achieved in that the pressure bore terminates in the end of the pressure groove adjacent the web.

According to an alternative embodiment of the invention, it may be provided that the damping groove and the pressure groove are formed by a single groove of steadily growing cross-section, which extends across a partial area or throughout the length of the control orifice associated with the pressure connection.

Another alternative for solving the problem encountered is provided by a restriction groove on the suction side of the control pin, employed with a radial piston pump. This arrangement can be employed together with the pressure side groove arrangements described above.

Through the configuration of the suction-sided control orifice according to the invention, in a piston pump of the type in question, a flow pattern is achieved in which below a full-load speed regulation, a high filling level is achieved, whereas above the full-load speed regulation, the rating is almost independent of the speed and is constant. Influences on the operating properties of the pump caused by the ambient temperature, the operating fluid and the varying operating pressures are low. The favorable filling pattern at speeds below the full-load speed regulation, at least at an elevated full-load speed regulation, permits a restriction of the means supporting the extension of the pistons, such as springs or an elevated piston weight. Moreover, pressure pulsations in the intake area of the pump can be reduced to a minimum by the invention.

The ratio of the area of the cross-section of the restriction groove,, to the stroke volume of a piston, preferably is in the range of 1:700 to 1:1200, more preferably 1:1000. The restriction groove, in the practice of the invention, can be in the form of a triangular groove having an aperture angle of about 60°. The restriction groove, especially at low speeds, permits a defined partial loading of the pumping chambers in the former part of the suction stroke, thereby preventing an excessive pressure gradient before reaching the suction bore.

To permit an easier variation of the throttle cross-sections and to enable the full-load speed regulation to be determined in accordance with the respective requirements and the pumping chambers to be decoupled from the pressure vibrations in the suction channel, according to another suggestion of the invention, the ends of the piston bores facing the control body are stepped within the rotor and, through piston stem bores of smaller diameter, can be connected to the control orifices. The diameter of the piston stem bores will have to be so selected as to cause the piston stem bores to act as a throttle restriction. Preferably, the ratio of the diameters of piston stem bore and piston bore is between 1:4 and 1:7.

The invention will now be described in closer detail with reference to some forms of embodiment as shown in the drawings.

DETAILED DESCRIPTION

Figure 1:
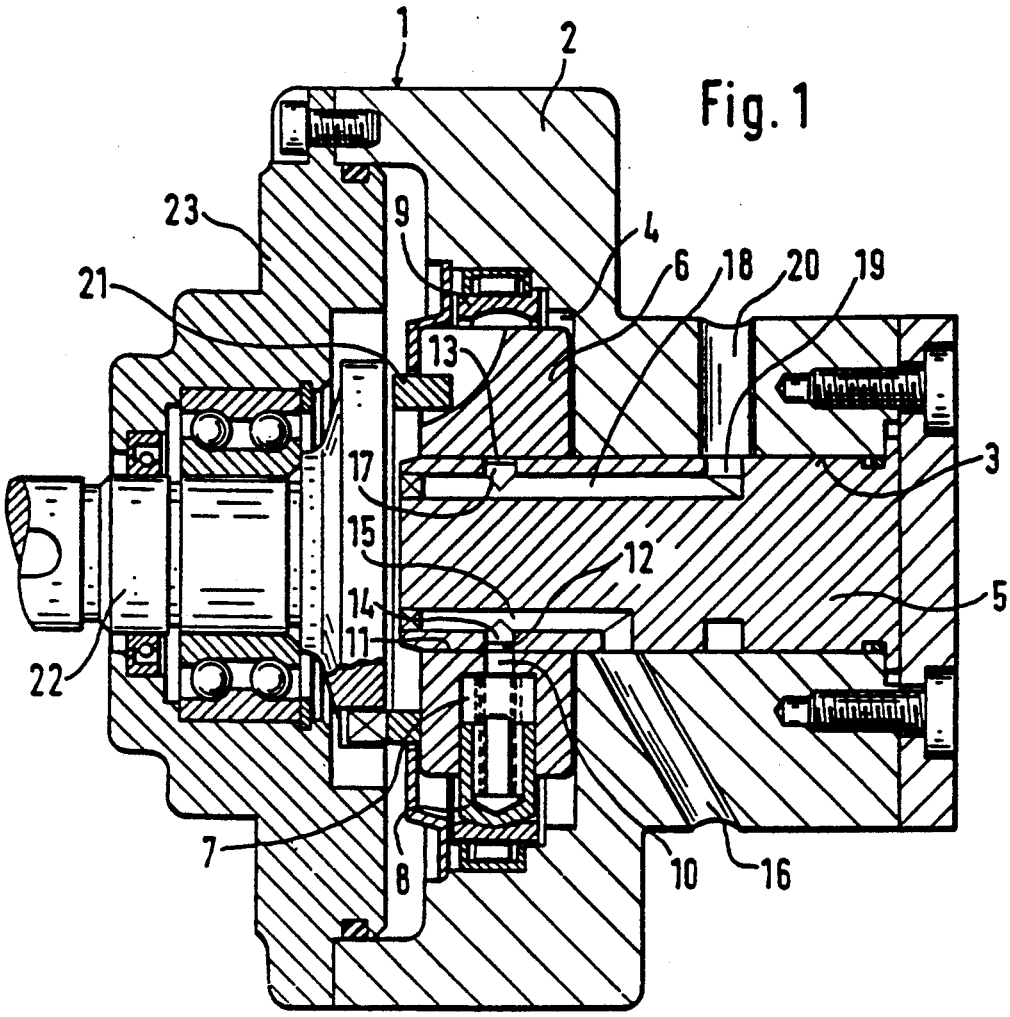
FIG. 1 is an axial section through a radial piston pump according to the invention.

Referring to the drawings, the radial piston pump 1 as shown in FIG. 1 has a substantially plate-shaped pump housing 2 formed with a continuous longitudinal bore 3 and a cylindrical recess 4 joining the latter. A control pin 5 is fixed a force fit, within the longitudinal bore 3, and which protrudes into the recess 4. Rotatably disposed on the control pin 5, in the radial recess 4, is a rotor 6 in which are formed a plural number of radially oriented piston bores 7 wherein pistons 8 are slidably movable. The pistons 8 with the outer ends thereof protruding from the piston bores 7 are supported on the inner face of a stroke ring 9 which by means of an anti-friction bearing is disposed eccentrically relative to the control pin 5 within the recess 4. The inner ends of the pistons 8 define pumping chambers in the piston bores 7. The radially internal ends of the piston bores 7 are stepped within the rotor 6 and are connected to piston stem bores 10 which terminate in the central bearing bore 11 of the rotor 6. As noted above, the stem bores 10 create throttle restrictions, as the ratio between the diameters of the piston bores 7 and stem bores 10 is between 1:4 to 1:7.

Formed in the control pin 5, in the plane of the piston stem bores 10, are control orifices 12,13 which upon rotation of the rotor 6 successively communicate with the piston stem bores 10. The control orifice 12 is located in the intake area of the pistons 8 and, through a suction bore 14, is in communication with a suction channel 15 extending within the control pin 5 in the longitudinal direction, which suction channel 15 is in communication with a suction connection 16. The control orifice 13 is located in the pressure area of the pistons 8 and, through the pressure bore 17, is connected to a pressure channel 18 formed within the control pin 5 in parallel to the suction channel 15. The pressure channel 18 terminates in an annular groove 19 which is in communication with a pressure connection 20.

The rotor 6, through a coupling 21, is driven by a shaft 22 extending through a cover 23 closing the recess 4.

Figure 3:
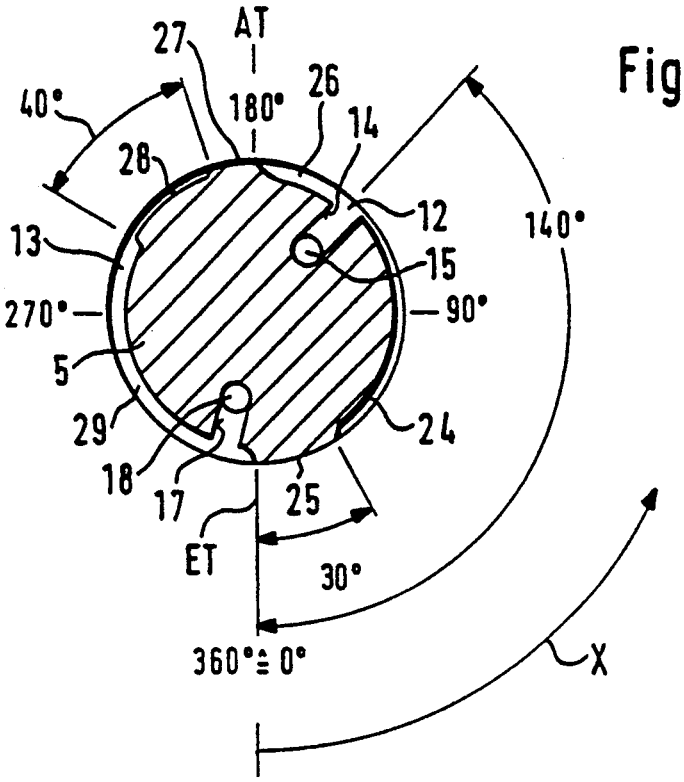
FIG. 3 is a cross-section in the plane of the control orifices through the control pin of the radial piston pump according to FIG. 1.
Figure 4:
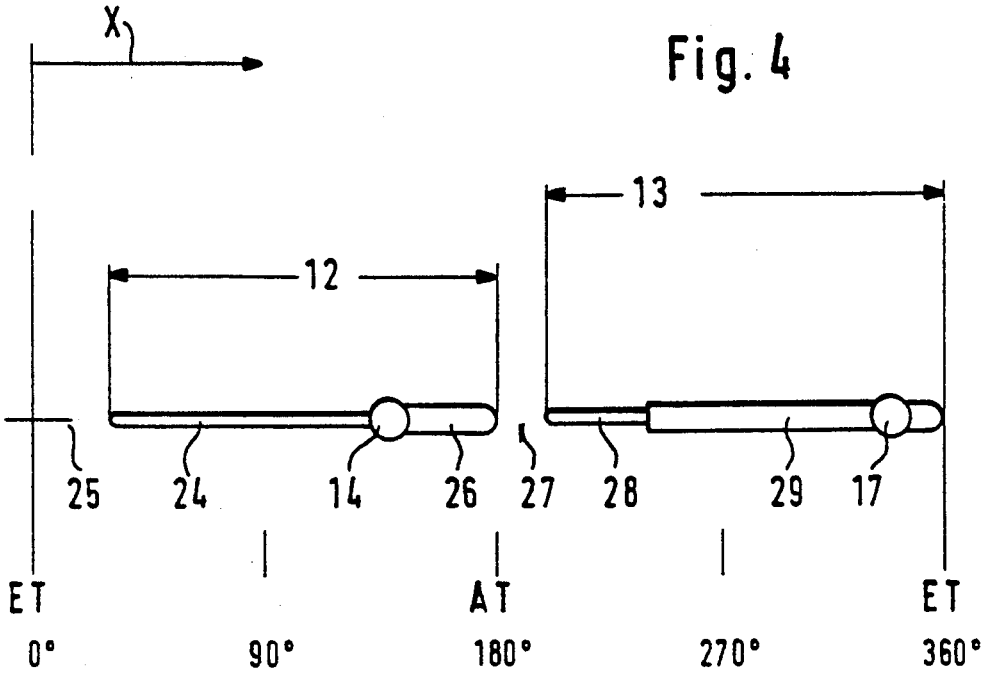
FIG. 4 is a projection into a plane of the pattern of control orifices of FIG. 3.

The configuration of the control orifices 12,13 in the control pin 5 is shown in FIGS. 3 and 4. The layout of the flow cross-sections of the control orifice 12 located in the area of the suction stroke of pistons 8 determines the maximum volumetric rate and filling level and insures a damping of the pressure pulsations on the intake side. The control orifice 12 is subdivided in three different areas, with the first one commencing at a location of about 30°, viewed in the direction of rotation of the rotor 6 marked by arrow X following the suction-mode dead center ET resulting from the lowest space between the control pin 5 and the stroke ring 9 creating a minimum volume of the pumping chambers in the bores 7.

The area is configured as a restriction groove 24 of small cross-section. The restriction groove 24 is in the form of a triangular groove having an aperture angle of about 60°. The aperture width thereof, preferably, is between 0.7 and 1.2 mm. It is especially at low speeds that the restriction groove 24 insures a defined partial filling of the piston bores 7, preventing an excessive pressure decrease before reaching the suction bore 14, thereby reducing pressure pulsations.

The narrow restriction groove 24 directly terminates in the suction bore 14 forming the second section of the control orifice 12, which is located at a space of about 140° from the suction-mode dead center ET.

The suction bore 14 is joined by a filling groove 26 of larger cross-section, forming the third section, with the filling groove 26 terminating in the compressed-mode dead center AT. It is especially the position of the suction bore 14 that determines the effective full-load speed regulation of the radial piston pump 1, with the filling groove 26 of a comparatively large cross-section improving mainly the filling level at speeds below the full-load speed regulation. By selecting the length of the filling groove 26 to be short, conversely, a heavy restriction of the suction flow, in the piston stem bores 10, can be largely foregone, thereby reducing the susceptibility of the pump to clogging by the entrance of dirt.

If a low full-load speed regulation is desired, the suction bore 14 can be disposed immediately before the compressed-mode dead center AT, foregoing a filling groove 26.

The control orifice 13 in communication with the pressure connection 20, in the area of the compressed-mode dead center AT, is separated by a web 27 from the filling groove 26. It is subdivided into two sections, a damping groove 28 and a pressure groove 29. The cross-section of the damping groove 28 is small. Tests have shown that triangular grooves having an aperture angle of about 60° and an aperture width of between 0.6 and 1 mm are adequate for a large variety of end-use applications. The angular range of the damping groove 28, in the described embodiment, is 40°. The damping groove 28 firstly serves to avoid the gradient of the pressure rise in the piston bores 7 at speeds above the full-load speed regulation. At such speeds, the piston bores 7, when opening into communication with the control orifice 13, in part are filled with pressure fluid and in part with vapor. Due to the high systems pressure prevailing in the control orifice 13, pressure fluid flows back into the piston bores 7, thereby filling the same.

In this connection, a pressure decrease occurs and immediately thereafter, in view of the displacement work of the pistons 8, a renewed rise in the pressure to the level of the systems pressure takes place. Due to the throttling effect of the damping groove 28, the return flow in the piston bore 7 is damped while the pressure fluid, through the retraction movement of the pistons 8, is compressed therein. In this manner, a comparatively slow pressure equilibrium is achieved between the piston bores 7 and the pressure connection 20, and the pressure pulsations are substantially reduced.

Moreover, the cross section of the pressure groove 29 joining the damping groove 28 which, although markedly larger, is reduced to a minimum value, and also contributes to the damping of pressure pulsations. The pressure groove 29 extends to the suction-mode dead center ET, thereby permitting delivery of the pistons 8 until the maximum retraction position is reached.

The pressure bore 17 terminates in the end of the pressure groove 29 adjacent the suction-mode dead center ET, thereby equally contributing to the damping effect of the pressure groove 29.

Figure 5:
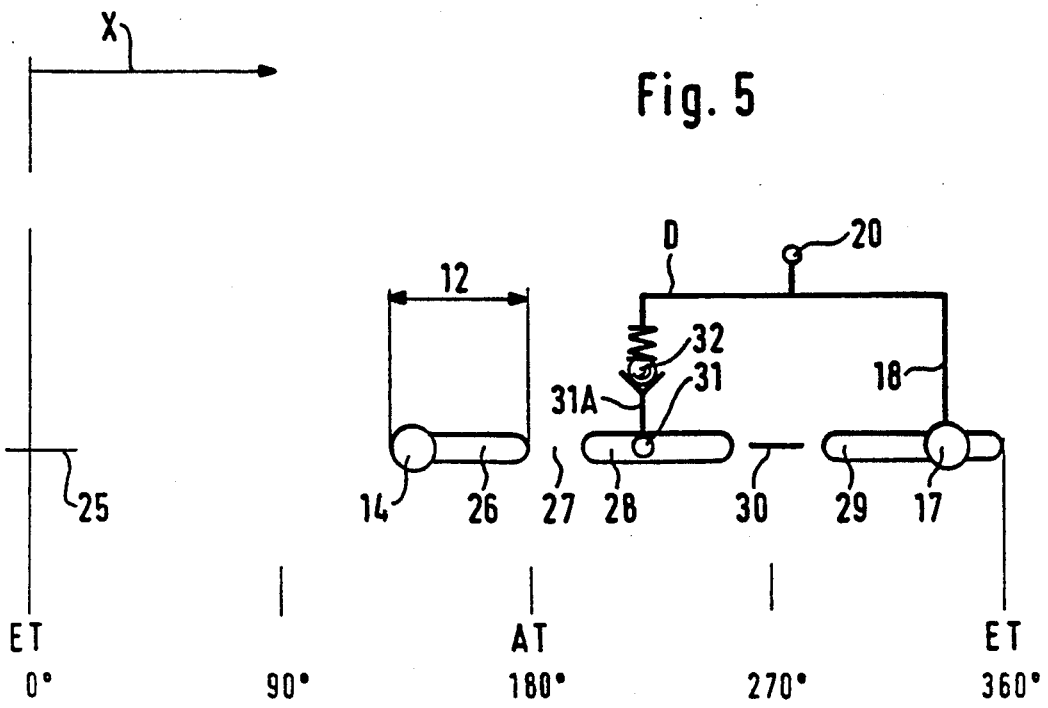
FIG. 5 is a projection into a plane of the pattern of another form of the control orifices including a separate damping groove.

FIG. 5 shows a projection in a plane for a preferred solution which differs from the one of FIG. 4. The essential difference over FIG. 4 resides in that a restriction groove 24, on the intake side, is eliminated, and also on the pressure side, the pressure control groove 28 has a check valve 32 (roughly corresponding to the previously described damping groove). Also the surface of the control pin 5 no longer passes into the pressure groove 29, but is rather separated therefrom by a separating web 30. The communication is effected through a radial bore 31 symbolically shown in FIG. 5 as line 31 A. The radial bore 31 and, hence, the damping groove 28, through a check valve 32 and a damping channel D, are in communication with the pressure connection 20.

The pressure control opening is configured as a pressure groove 29 which, through the pressure bore 17 and a pressure channel 18, is in communication with the pressure connection 20 as previously described in connection with FIG. 1.

The check valve 32 may be provided in the radial bore 18, in the pressure channel D, and even at the end of the pressure channel D in the connecting area toward the pressure connection 20 within the housing.

The diameter of the radial bore 31, in this instance, is shown slightly smaller than the diameter of the bores 14 and 17. However, the radial bore 31 may be of the same diameter as the afore-mentioned bores. Also, the width and the diameter of the radial groove 28 shown in FIG. 5 are substantially uncritical so that it may be of the same width as the grooves 26 and 29. Also, it is possible to provide between grooves 28 and 29 or in lieu of groove 28, a plural number of single series-arranged grooves which, respectively through a check valve of their own, are in communication with the pressure connection 20. This will insure an enhanced output and a reduced noise development.

Compared to FIG. 4, in addition, the restriction groove 24 has been foregone as this will permit a substantial simplification of the configuration of the grooves which now will all be of the same shape. The reduced output and the increased noise caused thereby is extremely low so that this is deemed to be a solution preferred over the one of FIG. 4.

The position of the suction bore 14 over the filling groove 26 is substantially uncritical as long as only the intake bore 14 is in the area of the filling groove 26. The length of the filling groove substantially is determined by the desired throttling effect as the filling level of the respective pump cylinder increases with the length of the filling groove 26.

Figure 2:
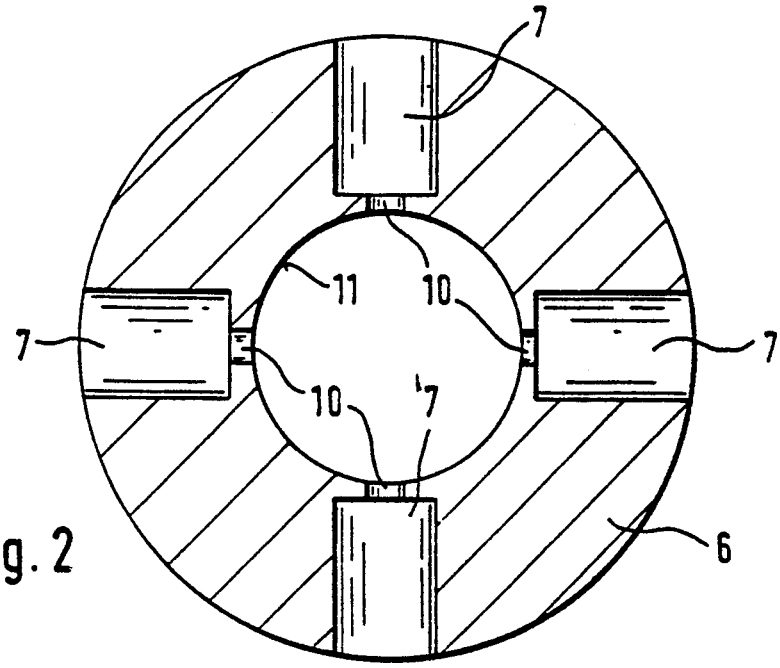
FIG. 2 is a cross-section through a rotor of the radial piston pump according to FIG. 1.

Basically, FIG. 5 clearly shows that the pressure-sided control orifice 13 according to FIG. 4 has been subdivided into two grooves by a separating web 30, with the stepped pressure control groove 28 accepting pressure fluid from the piston bore 7 (FIGS. 1 and 2), thereby substantially contributing to the rating of the pump, whereas a return flow from the groove 29, through the channels 18,D, from the groove 29 under a higher pressure into the pressure control groove 28 is prevented from occurring by the check valve 32.

Figure 6:
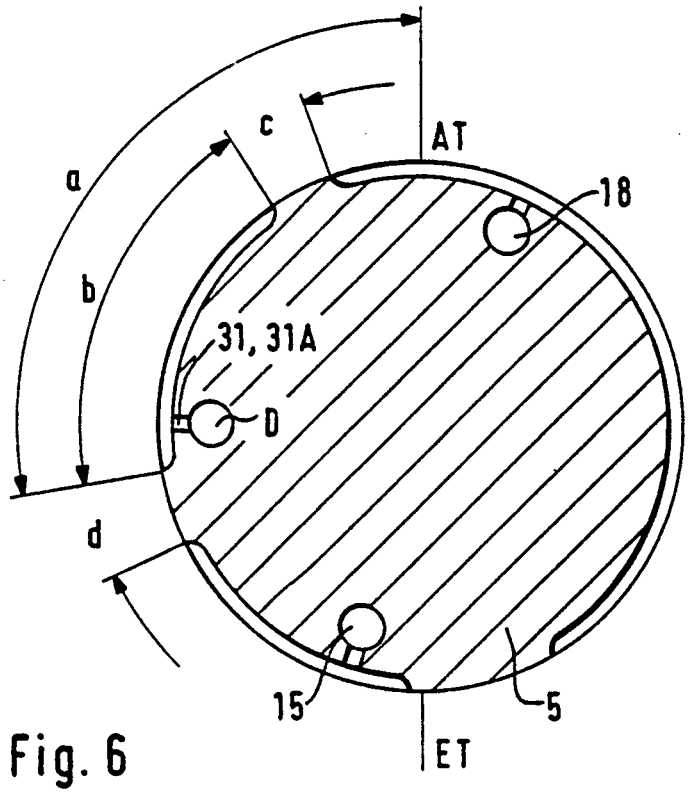
FIG. 6 is a diagrammatic section through the control pin with a reverse direction of rotation of the rotor, showing variations of the angular ranges from the embodiment of FIG. 5.

The angular position of the grooves and bores as shown in FIG. 5 is not imperative. A distributed position of the type as shown in FIG. 6 has rather also proved to be successful. It shows, in accordance with FIG. 3, but with a reverse direction of rotation of the rotor, or the channels 15,18 and D extending normal to the viewer's plane, with the individually shown angles being sized as follows: a=110°; b=70°; c=20°.

We claim:

1. A suction-restricted radial piston pump, comprising a housing having a cylindrical recess formed therein, a rotor mounted for rotation in said recess in a direction about an axis eccentric to said cylindrical recess, said rotor formed with a plurality of radial piston bores, a plurality of pistons slidably received within said piston bores of said rotor, a stroke-generating member engaging one end of each of said pistons, the other end of each of said pistons defining pumping chambers in said rotor piston bores, and a fixed control pin received within said rotor, said pumping chambers each having a portion opening onto the surface of said control pin, the surface of said control pin formed with circumferential extending respective suction and pressure control grooves, a suction channel and a pressure channel communicating respectively with said suction and pressure control grooves, said control grooves separated by webs, with said control grooves, upon rotation of said pressure chambers in said rotor, successively communicating with said piston bores, characterized in that said pressure control groove is comprised of two connected sections, a first section comprising a damping groove, and a second pressure control section of larger cross sectional area than said first pressure control groove section.

2. A piston pump according to claim 1, wherein the ratio of the area of the cross-section of said damping groove to the stroke volume of each piston, is in the range of 1:1000 to 1:1600.

3. A piston pump according to claim 1, wherein the area of the cross-section of said pressure groove second section is at least twice as large as the area of the cross-section of said damping groove.

4. A piston pump according to claim 1, further including a pressure bore terminating in an end of said pressure groove, a web adjacent to and separating said pressure groove from said suction groove.

5. A suction-restricted radial piston pump, comprising a housing having a cylindrical recess formed therein, a rotor mounted for rotation in said recess in a direction about an axis eccentric to said cylindrical recess, said rotor formed with a plurality of radial piston bores, a plurality of pistons slidably received within said piston bores of said rotor, a stroke-generating member engaging one end of each of said pistons, the other end of each of said pistons defining pumping chambers in said rotor piston bores and a fixed control pin received within said rotor, said pumping chamber each having a portion opening onto the surface of said control pin, said control pin formed with respective suction and pressure control orifices, a suction channel and a pressure channel communicating respectively with said suction and pressure control orifices, said control orifices separated by webs, with said control orifices, upon rotation of said pressure chambers in said rotor, successively communicating with said piston bores, wherein said control orifice associated with said suction connection comprises a restriction groove formed into the surface of said control pin extending circumferentially partly around said control pin, of small cross-sectional area, said restriction grooves beginning adjacent said suction-mode dead center whereat said pumping chambers are at minimum volume, a suction bore joining said restriction groove, and, with said suction bore spaced from a rotor dead center at which said pumping chambers are at maximum volume, and further including a filling groove of larger cross sectional area than said restriction groove, which supply groove extends from said suction bore towards said rotor maximum volume dead center.

6. A piston pump according to claim 5 wherein the ratio of the area of the cross-section of said restriction groove to the stroke volume of a piston, is in the range of 1:700 to 1:1200.

7. A piston pump according to claim 5 wherein said portion of said piston bores opening onto said control pin are stepped forming piston stem bores of smaller diameter in communication with said control orifices.

8. A piston pump according to claim 7, wherein the ratio of the diameters of said piston stem bores, and said piston bores is between 1:4 and 1:7.

* * * * *